United States Patent [19]

Mogami et al.

[11] Patent Number: 4,912,903

[45] Date of Patent: Apr. 3, 1990

[54] SPACE FRAME USING SQUARE STEEL TUBULAR MEMBERS

[75] Inventors: Kimihiko Mogami; Michihiko Ohta; Kouki Hatanaka; Noriaki Numakura; Mamoru Kimura; Akira Okada; Norihisa Okuno, all of Toyo, Japan

[73] Assignee: Takenaka Corporation, Osaka, Japan

[21] Appl. No.: 311,946

[22] Filed: Feb. 17, 1989

[30] Foreign Application Priority Data

Aug. 16, 1988 [JP] Japan ..... 63-203565

[51] Int. Cl.[4] ..... E04C 3/04

[52] U.S. Cl. ..... 52/648; 52/DIG. 10

[58] Field of Search ..... 52/648, 690, DIG. 10, 52/650, 693

[56] References Cited

U.S. PATENT DOCUMENTS

| | | | |
|---|---|---|---|
| 3,685,221 | 8/1972 | Mamgan | 52/DIG. 10 |
| 3,827,206 | 8/1974 | Nierle | 52/648 |
| 3,948,012 | 4/1976 | Papayoti | 52/648 |
| 4,282,619 | 8/1981 | Rooney | 52/648 |
| 4,648,223 | 3/1987 | Richard | 52/DIG. 10 |
| 4,746,056 | 3/1988 | Thomsen | 52/648 |

FOREIGN PATENT DOCUMENTS

| | | |
|---|---|---|
| 3821585 | 10/1936 | Japan . |
| 62-96403 | 6/1987 | Japan . |

*Primary Examiner*—Carl D. Friedman
*Assistant Examiner*—Caroline D. Dennison
*Attorney, Agent, or Firm*—Ronald P. Kananen

[57] ABSTRACT

A space frame comprises an upper frame body and a lower frame body both constructed with square steel tubular members; and diagonal members joining the upper frame body to the lower frame body. Each pair of two perpendicular sides of each of the square steel tubular members forming the lower frame body are arranged to make an angle of about 45 degrees to the plane of the lower frame body. The diagonal members are arranged to cross at an angle of about 45 degrees to bar members both of the upper and lower frame bodies. The space frame provides increased buckling strength because the bar members and the diagonal members may be entirely joined by welding.

1 Claim, 6 Drawing Sheets

SPACE FRAME USING SQUARE STEEL TUBULAR MEMBERS

BACKGROUND OF THE INVENTION

The present invention relates to a space frame which is used for a long-span roof of a building, or a long-span framing structure used for an artificial foothold to construct a building over a road, rails, a river or other impediment. Especially, the present invention relates to a space frame in which square steel tubular members are used for bar members and joined at each cross point thereof by welding.

A space frame is a well-known device. Especially as shown in FIGS. 1 through 3, a space frame having an upper frame body 2 constructed with upper bar members 1 and 1' joined perpendicularly to form a lattice pattern having square grids; a lower frame body constructed with lower bar members 3 and 3' also joined perpendicularly to form a grid pattern having square grids wherein the upper and lower frame bodies 2 and 4 are arranged in a configuration such that respective bar members of the upper and lower frame bodies make an angle of about 45 degrees with respect to the planes of the frame bodies, and the upper and lower frame bodies 2 and 4 are united by joining a number of sets of four diagonal members 5 in the shape of an upended pyramid between cross points of bar members 1 and 1' and cross points of the lower bar members 3 and 3', is long known (refer to, for example, Japanese Published Examined Patent Ser. No. 38-21585=Japanese Patent Ser. No. 443434).

Also, it is well-known to use square tubular members for bar members of a truss in such a way that two perpendicular sides of each square steel tubular member make an angle of about 45 degrees to the plane of the truss frame body, and the bar members are joined by fillet-welding at each cross point for constructing a truss structure (refer to, for example, Japanese Unexamined Utility Model Application No. 62-96403).

The problems of the conventional space frame will be discussed as follows.

(a) Generally, circular hollow section members are used for bar members of a conventional space frame. In this case, the bar members are joined by welding along a curved surface at the joint section, so that this work is very difficult and takes a long time. Square steel pipes are used to settle this problem. The square pipes are generally used in a configuration such that two perpendicular sides of each of the square steel pipes are respectively aligned in parallel and perpendicular to the plane of the frame bodies. In this case, cross points of bar members are joined by butt-welding along a short weld line. This prevents the lower frame body from having enough reliability in weld strength in view of the fact that the lower body must bear a tension load. Further, it is required to inspect welded sections by ultra-sonic flaw detection, which takes long time.

Consequently, a molded steel pole-joint is required to be used at each cross point of the conventional space frame. The bar members are joined with each other through the pole-joint. However, the pole-joint is very expensive, so that it increases the cost of the space frame due to its usage. Also it increases the weight of the space frame by its weight. Moreover, since a joint by the pole-joint is a so-called pin joint, the bar member and the diagonal member can not have enough buckling strength, that is, the buckling load of the whole space frame is caused to be low. This requires the bar member to have larger cross section. As the result of that, the space frame is expensive and heavy.

(b) The truss structure, described in the Japanese Published Unexamined Utility Model Application No. 62-96403, has the feature that the bar member and the diagonal member are tightly joined at the cross points by fillet-welding. However, that application does not disclose and suggest a technical concept relating to a space frame.

SUMMARY OF THE INVENTION

In order to solve the problems of the above discussed prior art, a space frame using square steel tubular members is constructed in a preferred embodiment as shown in the drawing as follows:

In a space frame in which an upper frame body and a lower frame body each constructed by joining bar members perpendicularly with each other to form a crossing pattern are arranged in a configuration such that respective bar members of the upper and lower frame bodies make an angle of 45 degrees with respect to the planes of the frame bodies; and the upper and lower bodies are united by joining diagonal members forming a shape of an upended pyramid between respective cross points of the bar members.

(a) the upper frame body 2 is constructed by welding members in a configuration such that square steel tubular members 1 and 1' used for the bar members have two perpendicular sides 1*a* and 1*b* aligned respectively parallel and perpendicular to the plane of the upper frame body (shown in the FIG. 4);

(b) the lower frame body 4 is constructed by welding members in a configuration such that square steel tubular members 3 and 3' used for the bar members have two perpendicular sides 3*a* and 3*b* making an angle of 45 degrees to the plane of the lower frame body (shown in the FIG. 4); and (c) the diagonal members 5 are joined between respective cross points of the upper and lower frame bodies 2 and 4 by fillet-welding along relatively long weld lines.

Objects and advantages of the present invention will become apparent from the following description of embodiments with reference to the accompanying drawings.

DRAWINGS

Figure 5:
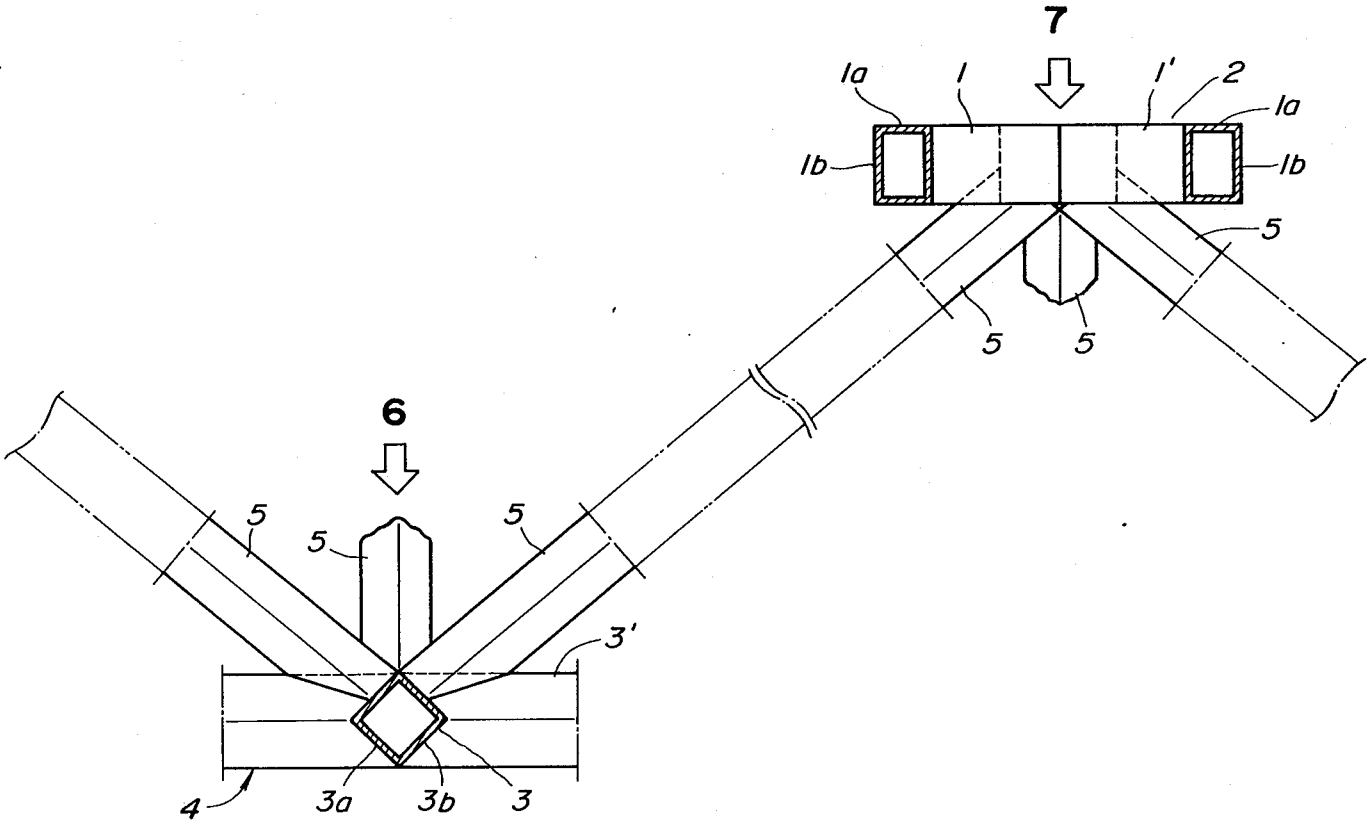
FIG. 5 is a front view of the space frame structure shown in the FIG. 4.
Figure 6:
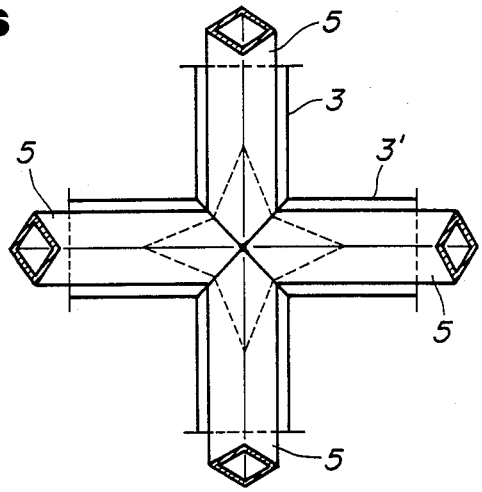
Figure 7:
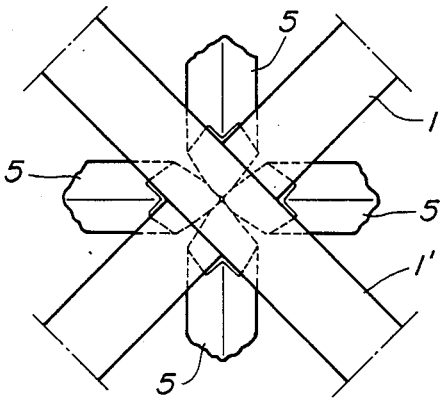
Figure 8:
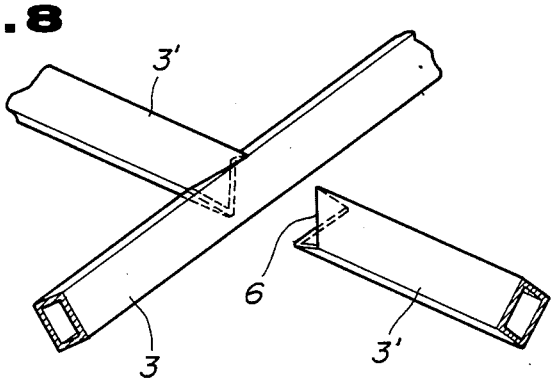
Figure 9A:
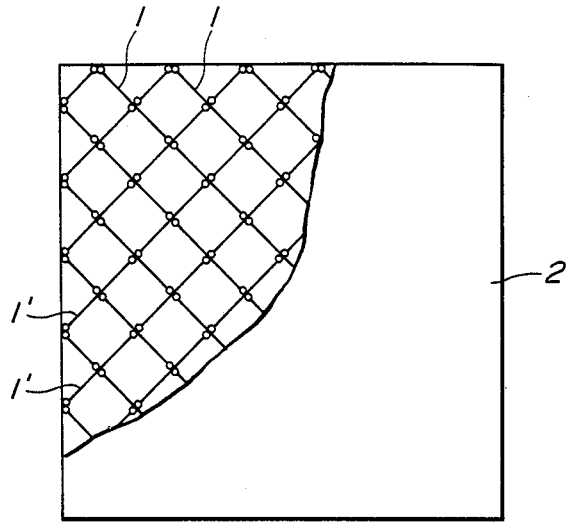
Figure 9B:
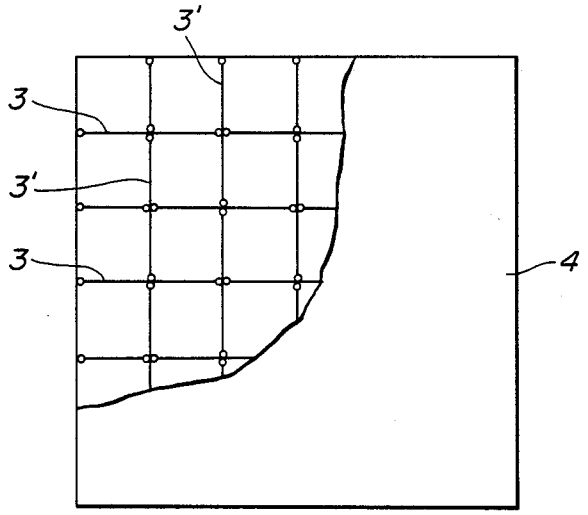

FIGS. 6 and 7 are plan views when viewed respectively in directions of arrows 6 and 7 in FIG. 5;

FIG. 8 is a perspective view showing a joint section of a lower frame body using square steel tubular members; and FIGS. 9A and 9B are simplified plan views respectively showing joined structures of the upper and lower frame bodies.

DETAILED DESCRIPTION OF THE INVENTION

Figure 4:
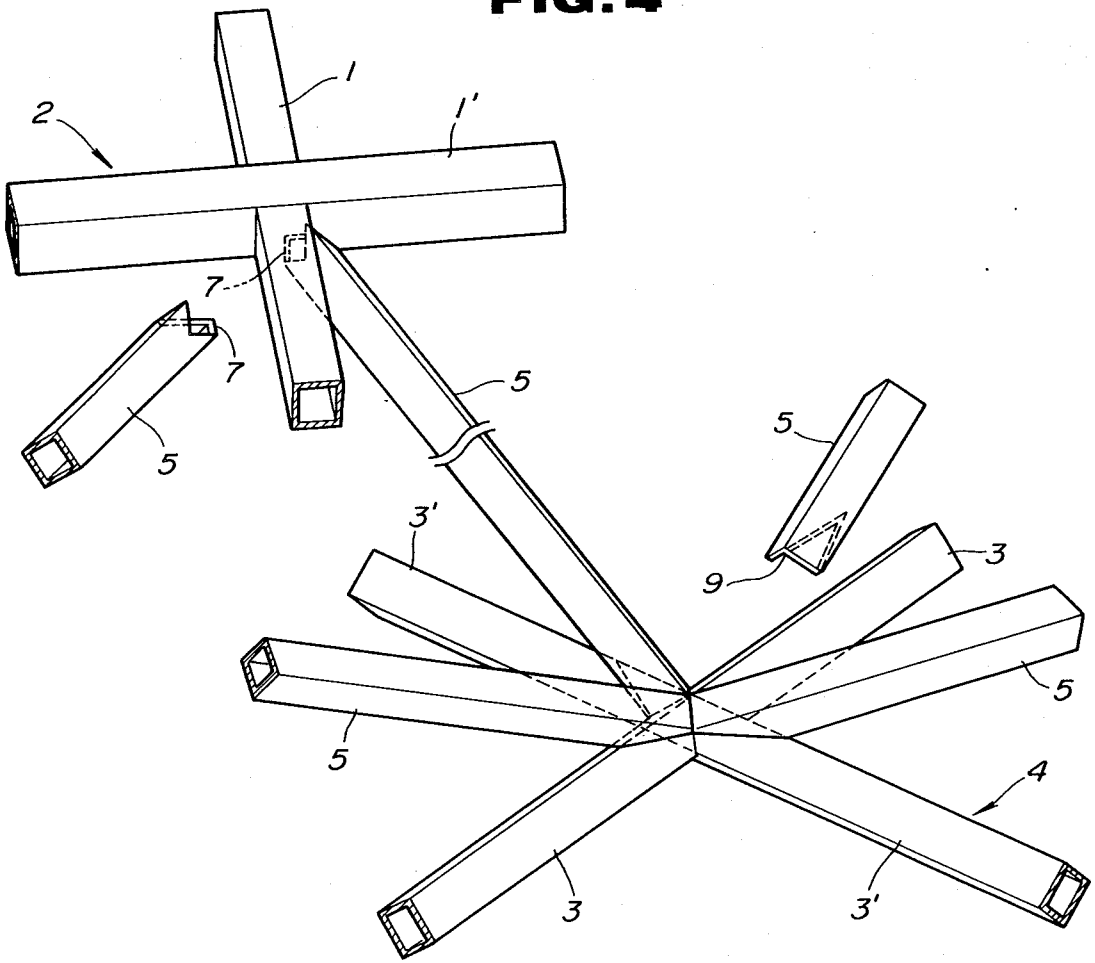
FIG. 4 is a detailed perspective view showing the space frame using square steel tubular members.

Referring to FIG. 4, square steel tubular members 1 and 1' perpendicularly crossing each other are joined by butt-welding only along the circumference of the square steel tubular members 1 and 1' to construct an upper frame body 2. This welded joint section has enough reliable strength because the upper frame body 2 is on the compression load side in a space frame structure. The top side of the upper frame body 2 is formed with horizontal planes of the square steel tubular members being convenient for working men to walk on the frame body and to lay roof material or the like.

Square steel tubular members 3 and 3' of the lower square body 4 are joined perpendicularly with each other in an arrangement such that two perpendicular sides 3*a* and 3*b* make an angle of about 45 degrees to the plane of the lower frame body 4. When a weld joint portion 6 of the square steel tubular member on the contacting side is cut into a V-shape having an angle of 90 degrees, the weld joint portion 6 can be joined by fillet-welding. The length of the weld line is calculated by multiplying a square root of 2. Therefore, even if the lower frame body 4 is on the load side, the welded joint section of the bar members 3 and 3' has enough strength because of fillet-welding. Further, the welded section can be inspected merely by viewing a padding. Also, it is not necessary to use conventional pole-joints.

In addition, since each diagonal member 5 is inevitably arranged to cross at an angle of an about 45 degrees in three-dimensional space to the bar members 1 and 1' of the upper frame body 2 and the bar members 3 and 3' of the lower frame body 4, weld joint portions 7 and 8 on both ends of the diagonal member 5 can be joined by fillet-welding along a long enough weld line. This provides reliable strength at the welded section and an ease of inspection for the welded section.

After all, with this space frame, joining at all cross points can be performed by welding to provide a rigid joint between bar members. This allows the entire structure of the space frame to have increased buckling strength. Therefore, an inexpensive and light weight space frame is provided by using bar members each having a relatively small cross section. Further, all of the bar members 1 and 3, and the diagonal members 5 can be manufactured as standard modules in a factory and constructed in high quality on the spot.

Preferred embodiments of the present invention will be further described in detail hereinafter.

Figure 1:
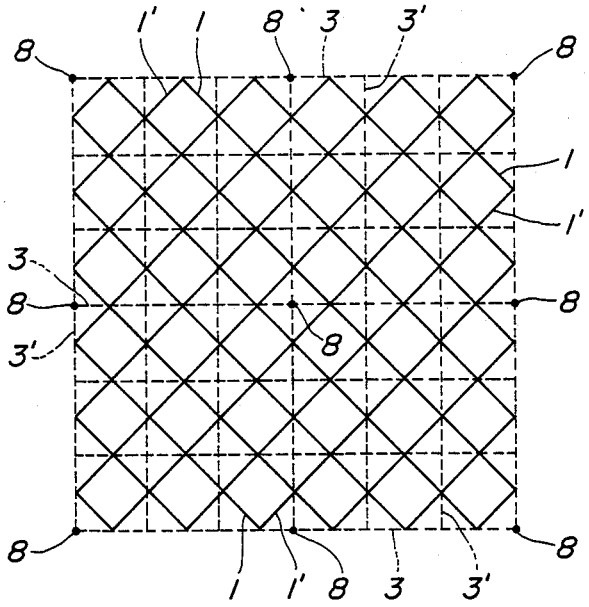
FIGS. 1 and 2 are respectively a simplified plan view and a side view of a space frame according to the present invention.
Figure 2:
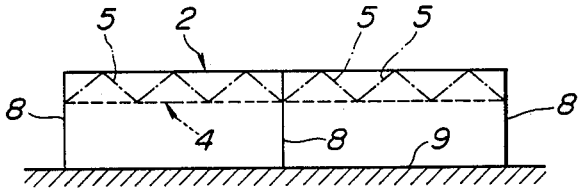
Figure 3:
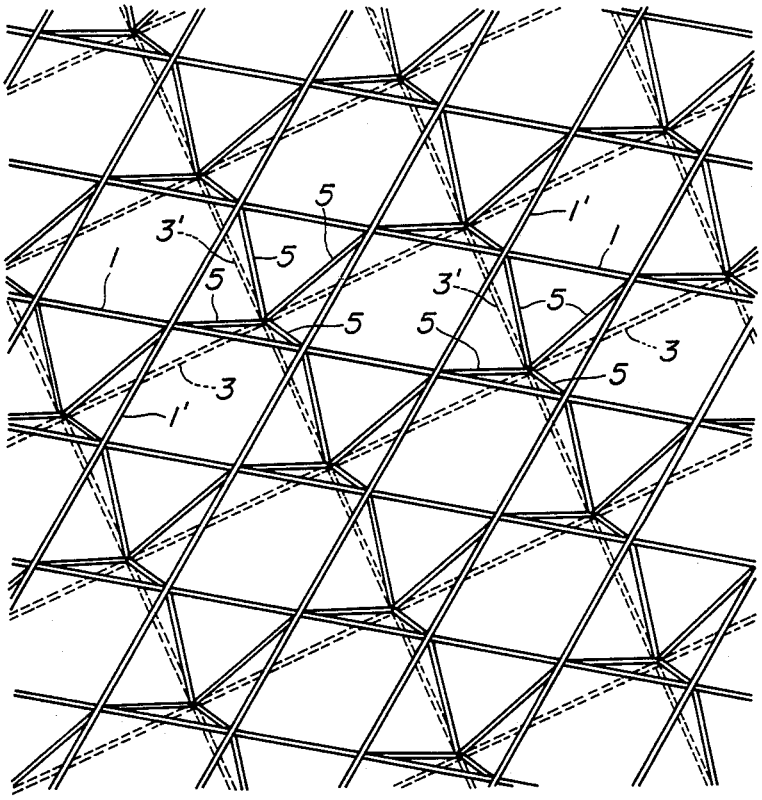
FIG. 3 is a simplified perspective view showing a main section of the space frame structure.

FIGS. 1, 2 and 3 illustrate the fundamental constructive principle of the space frame according to the present invention.

In the FIG. 2, the upper and lower frame bodies 2 and 4 are respectively indicated by solid and dotted lines for convenience of identification. The frame body 2 is constructed with the bar members 1 and 1' joined perpendicularly to form a lattice pattern having regular square grids. Also, the frame body 4 is constructed with bar members 2 and 2' joined in same manner. The upper and lower frame bodies 2 and 4 are arranged in a configuration such that the bar members 1 and 1' and the bar members 3 and 3' make an angle of about 45 degrees with each other when viewed vertically, i.e, on the planes of the frame bodies, as shown in FIG. 1. Thus, the bar members 1 and 1' make an angle of 45 degrees to both of the longitudinal and lateral directions in FIG. 1. Each regular square grid of the lattice pattern formed with the bar members 1 and 1' has a dimension on each side of 1.84 m. On the other hand, the bar members 3 and 3' make a right angle to the the longitudinal and lateral directions in FIG. 1. Further the bar members 3 and 3' pass through points projected perpendicularly from the four corners of the individual regular square grids formed with the bar members 1 and 1' of the upper frame body 2 to the lower frame body 4. Each regular square grid of the grid pattern formed with the bar members 3 and 3' has a dimension of 2.5 m on each side. This means that the grids of the lower frame body 4 are larger than the ones of the upper frame body 2. By this arrangement of the two frame bodies 2 and 4 and the lengths of the respective sides thereof, each of the cross points, or each of the joined section of the lower frame body 4 is located in alignment with the center of a grid of the upper frame body 2.

The upper and lower frame bodies 2 and 4 constructed as described above are arranged in parallel with a space between them of about 1 m, as shown in FIG. 2. To construct a space frame, four diagonal members 5 are joined between four corners of each grid of the upper frame body 2 and each cross point of the lower frame body 4 located at the center of the upper frame body 2 as shown in FIG. 1. As the result of that, the four diagonal members 5 form an upended pyramid shape as shown in FIG. 3. Thus, referring FIG. 1, the diagonal members 5 extend along the lines of the bar members 3 and 3'. Further, the diagonal members 5 joined between the upper and lower frame bodies 2 and 4 form a checked pattern. The reference number 8 indicates each of pole-joints supporting the space frame above the ground.

The FIGS. 4 through 9 show a concrete construction of the foregoing space frame, specially regarding individual connecting section when using square steel tubular members for the bar members 1, 1', 3 and 3', and diagonal members 5.

Each of the square steel tubular members used for the bar members 1, 1', 3 and 3 has a cross section of a regular square with each side of about 750 mm and a thickness of about 19 mm to 28 mm. Also, each of the square steel tubular members used for the diagonal member 5 has a cross section of a regular square with each side of about 550 mm and a thickness of about 19 mm to 32 mm.

Referring to FIGS. 4, 5 and 7, the upper frame body 2 is constructed by butt-welding the square steel tubular members of the bar members 1 and 1' to each other. When joining the bar members 1 and 1', the two perpendicular sides 1*a* and 1*b* of the square steel tubular members are aligned to be respectively parallel and perpendicular to the plane of the upper frame body 2.

On the other hand, the lower frame body 4 is constructed by fillet-welding the square pipes of the bar members 3 and 3' to each other. When joining the bar members 3 and 3', the two perpendicular sides 3*a* and 3*b* of each of the square steel tubular members are aligned to make an angle of 45 degrees to the plane of the lower frame body 4.

As shown in FIG. 8, the square steel tubular members 3 and 3' make a right angle to each other. Joint portion 6 of the square steel tubular member 3' is cut into a V-shape having an angle of 90 degrees to contact closely with the corner the square steel tubular member 3. The joining between the joint portion 6 and the square steel tubular member 3 is done by fillet-welding. Because of this usage of a fillet-weld, the welded section can be easily inspected merely by viewing a padding thereof. Further, the weld line in this case is the square root of 2 times as long as the weld line formed by butt-welding in the upper frame body 2, thereby providing reliable joint strength.

Each diagonal member 5 is joined to a cross point of the upper frame body 2 at the top end thereof to make an angle of about 45 degrees in three-dimensional space as shown in FIG. 4. To do this, the joint portion 7 to be welded is cut into a V-shape having an angle of 90 degrees to contact closely with the corner of the cross point of the upper frame body 2. This allows the joint portion 7 to be fillet-welded to the upper frame body 2 along a long enough weld line, to provide reliable joint strength. Because of this usage a fillet-weld, the welded section can be easily inspected merely by viewing the padding thereof. The diagonal member 5 is also joined to a cross point of the lower frame body 4 at the bottom end thereof to make an angle of about 45 degrees to the plane of the lower frame body 4 in three-dimensional space as shown in FIG. 4. When the planes of the frame bodies 2 and 4 are viewed in plan, the diagonal members 5 appear to extend in four perpendicular directions along the square steel pipes 3 and 3'. Referring to FIG. 4, joint portion 9 to be welded is cut into a V-shape having an angle of 90 degrees to contact closely with the corner edge of the square steel tubular members 3 or 3' lying directly under the joint portion 9 at the cross point. In other words, the joint portion 9 sits astride on the corner edge of the square steel tubular member 3 or 3'. This allows the joint portion 9 to be fillet-welded to the lower frame body 4 along a long enough weld line to provide reliable joint strength. Because of this usage of a fillet-weld, the welded section can be inspected easily.

All the diagonal members 5 can have the same length and the weld joint portions having the same shape at the top and bottom ends thereof. Therefore, identical products are used for the diagonal members 5 so that they are manufactured as a standard module in a factory.

Also, for the upper frame body 2, when square steel tubular members 1 and 1' are welded at every two spans of a certain length marked by little circles as shown in FIG. 9A, they can be manufactured as a standard module in a factory. Similarly, for the lower frame body 4, when square steel tubular members 3 and 3' are welded at every two spans of a certain length marked by little circles as shown in FIG. 9B, and have the weld joint portions 6 cut into a V-shape as shown in FIG. 8, they also can be manufactured as a standard module in a factory.

Consequently, the space frame can be efficiently constructed in high quality on the spot, not to mention in a factory, by using three types of members (the square steel tubular members 1, 1', 3 and 3', and the diagonal members 5) manufactured as standard modules in a factory.

Further, it is possible to use circular hollow section members for the diagonal members.

As described above by referring to the embodiments, the flat solid truss using the square steel tubular members in accordance with the present invention provides increased buckling strength over the structure. This is because the bar members and the diagonal members'are entirely joined by welding to offer a rigid joint. Moreover, the increased buckling strength allows the bar members and diagonal members to have smaller cross sections, providing a light and inexpensive space frame.

Since the conventional pole-joints are not required, it is possible to reduce the cost and weight of the space frame in an amount corresponding to that of the pole-joints which would otherwise be used.

Further, since fillet welding is used between the bar members of the lower frame body 4 and between the diagonal members 5 and the upper and lower frame bodies 2 and 4, it is easy to inspect the welded joint sections. This will reduce the total cost of constructing the space frame.

In addition, the bar members 1, 1', 3 and 3' of the upper and lower frame bodies 2 and 4, and the diagonal members 5 can be mass-produced in a factory, because they can be manufactured as standard modules. Thus, the space frame of the present invention has an advantage in productivity and the convenience of permitting efficient and high quality construction on the site.

While the preferred embodiments of the invention have been shown and described herein, it will be apparent to those skilled in the art that many changes and modifications may be made without departing from the invention in its broader aspects. Therefore, the scope of the present invention should be determined only by the following claim.

We claim:

1. In a space frame in which an upper frame body and a lower frame body, each constructed by joining bar members perpendicularly with each other to form a crossing pattern in a plane to define cross points of the bar members, are arranged in a configuration such that projections of the bar members of either of the upper and lower frame bodies on the plane of the other frame body make angles of 45 degrees with respect to the bar members of said other frame body; and the upper and lower bodies are united by joining diagonal members forming a shape of an upended pyramid between respective cross points of the bar members of the upper frame body and the lower frame body, the improvement comprising:

(a) the bar members of the upper frame body are square steel tubular members having two perpendicular sides respectively parallel and perpendicular to the plane of the upper frame body, said tubular members being connected to one another by welds;

(b) the bar members of the lower frame body are square steel tubular members having two perpendicular sides making an angle of 45 degrees to the plane of the lower frame body, said tubular members being connected to one another by welds; and (c) the diagonal members are joined between respective cross points of the upper and lower frame bodies by fillet welds each having a relatively long weld line.

* * * * *